US008328413B2

(12) United States Patent
Lechot et al.

(10) Patent No.: US 8,328,413 B2
(45) Date of Patent: Dec. 11, 2012

(54) TIMEPIECE COMPRISING A CHRONOGRAPH AND A WATCH

(75) Inventors: Dominique Lechot, L'Orient (CH); Alain Zaugg, Le Brassus (CH)

(73) Assignee: Montres Breguet S.A., L'Abbaye (CH)

( * ) Notice: Subject to any disclaimer, the term of this patent is extended or adjusted under 35 U.S.C. 154(b) by 433 days.

(21) Appl. No.: 12/711,399

(22) Filed: Feb. 24, 2010

(65) Prior Publication Data

US 2010/0214879 A1 Aug. 26, 2010

(30) Foreign Application Priority Data

Feb. 24, 2009 (EP) ..... 09153518

(51) Int. Cl.
*G04B 15/00* (2006.01)
*G04B 1/10* (2006.01)
*G04B 17/00* (2006.01)

(52) U.S. Cl. ..... 368/124; 368/101; 368/127; 368/140; 368/169

(58) Field of Classification Search ..... 368/97–102, 368/124–127, 139–140, 168–169
See application file for complete search history.

(56) References Cited

U.S. PATENT DOCUMENTS

| | | | | |
|---|---|---|---|---|
| 2,969,636 | A * | 1/1961 | Batori et al. | 368/20 |
| 4,748,603 | A * | 5/1988 | Ray et al. | 368/80 |
| 5,220,541 | A * | 6/1993 | Vuilleumier | 368/88 |
| 5,793,708 | A * | 8/1998 | Schmidt et al. | 368/106 |
| 6,406,176 | B1 * | 6/2002 | Takahashi et al. | 368/101 |
| 2006/0221775 | A1 * | 10/2006 | Zaugg | 368/127 |
| 2008/0192583 | A1 * | 8/2008 | Buttet et al. | 368/127 |

FOREIGN PATENT DOCUMENTS

| | | | |
|---|---|---|---|
| CH | 156 801 | A | 8/1932 |
| EP | 1 333 345 | A | 8/2003 |
| WO | 2005/043257 | A | 5/2005 |

OTHER PUBLICATIONS

Search report issued in corresponding European application No. 09153518, completed Aug. 14, 2009.
Humbert, B., "Le Chronographe" by Scriptar SA, La Conversion, (Switzerland), 1990, pp. 6-9.

* cited by examiner

*Primary Examiner* — Vit W Miska
(74) *Attorney, Agent, or Firm* — Griffin & Szipl, P.C.

(57) ABSTRACT

The timepiece includes a chronograph whose hands are driven by a first gear train (4), which in turn drives a first resonator (5) and a watch whose hands are driven by a second gear train (8) independent of the first gear train, wherein the second gear train in turn drives a second resonator (9). The first (4) and second (8) gear trains are driven from a single energy source (10).

4 Claims, 3 Drawing Sheets

TIMEPIECE COMPRISING A CHRONOGRAPH AND A WATCH

This application claims priority from European Patent Application No. 09153518.7, filed Feb. 24, 2009, the entire disclosure of which is incorporated herein by reference.

FIELD OF THE INVENTION

The present invention relates to a timepiece comprising a chronograph whose hands are driven by a first gear train, which in turn drives a first resonator and a watch, whose hands are driven by a second gear train, independent of the first, wherein said second gear train in turn drives a second resonator.

BACKGROUND OF THE INVENTION

As is generally the case in a timepiece that combines a chronograph and a watch, the gear train driving the chronograph is derived from the gear train driving the watch, and the timepiece has only a single energy source and a single resonator. By way of concrete example, cited in the work of B. Humbert "Le Chronographe" by Scriptar SA, La Conversion, (Switzerland), 1990, the top pivot of the fourth wheel set of the watch is extended to fit thereon a wheel with a contraet toothing, or a first chronograph drive wheel. The latter wheel is permanently meshed with an intermediate wheel secured to a coupling lever controlled by a column wheel, which is in turn controlled by a push button. When the lever is actuated, the intermediate wheel, also called the coupling wheel, drives a chronograph wheel set secured to a direct drive seconds-hand that completes one revolution per minute.

It will be clear that the method that has just been briefly described leads to instability in the time displayed by the watch when the chronograph is working. This instability is caused by a loss of torque causing a decrease in the impulse energy transmitted to the sprung balance. Thus, the working precision of the watch is affected when the chronograph is working.

A solution has been proposed to avoid the aforecited drawbacks. EP Patent No. 1333345 proposes a device comprising a watch whose time indicators are driven by a first barrel connected to a first gear train and a first regulating member, and an autonomous chronograph module whose indicators are driven by a second barrel, which is independent from the first, connected to a second gear train and a second regulating member.

SUMMARY OF THE INVENTION

The device described above ensures that the two movements are properly independent and thus that the working of the watch is undisturbed when the chronograph is operating. This independence is achieved, however, at the expense of a complicated system that relies, in particular, on a double barrel.

The present invention remedies this situation. Indeed, the timepiece proposed by the invention, not only complies with the statement of the first paragraph of this description, but it is original in that the first and second gear trains are driven from a single energy source.

BRIEF DESCRIPTION OF THE DRAWINGS

The invention will now be explained in detail below via an embodiment, which is given by way of non-limiting example and is illustrated by the annexed drawings, in which.

DETAILED DESCRIPTION OF THE ILLUSTRATIVE EMBODIMENTS

Figure 1:
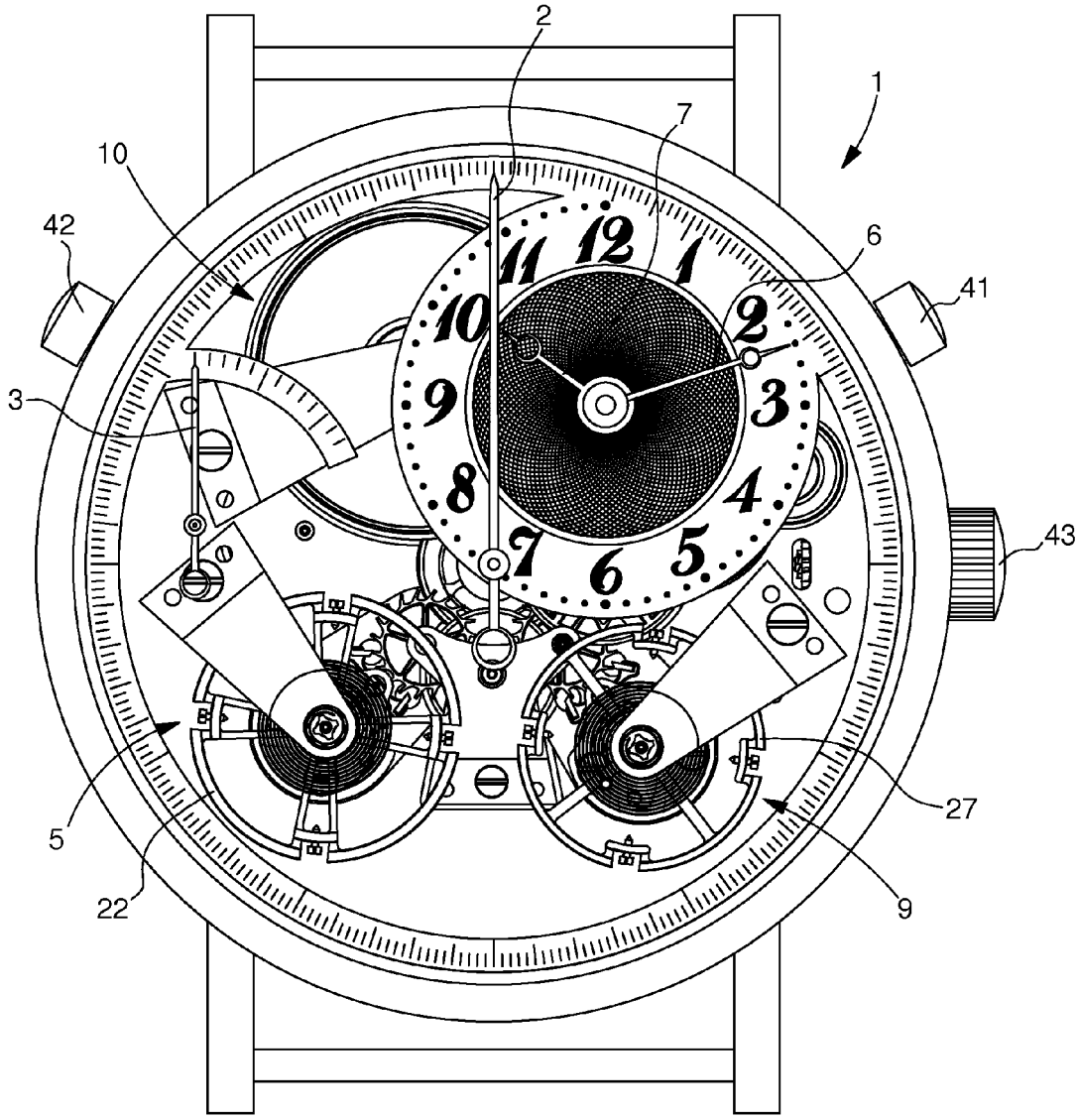
FIG. 1 is a general plan view of the timepiece made in accordance with the present invention.
Figure 2:
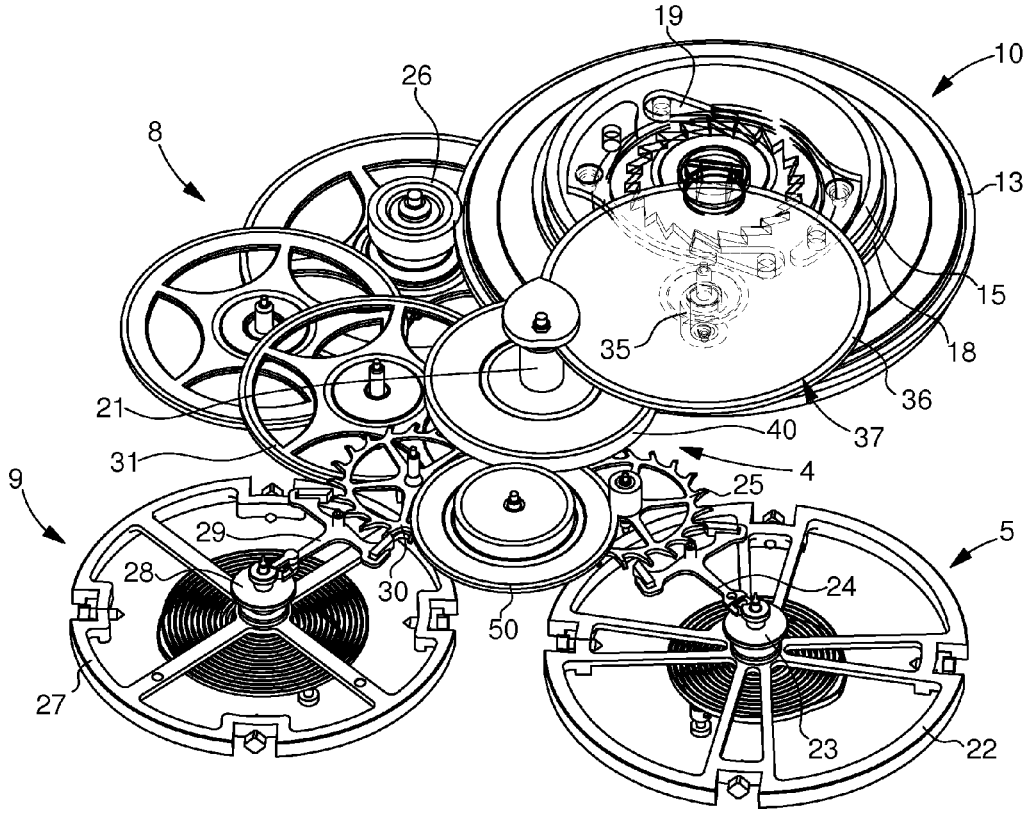
FIG. 2 is a perspective view of the essential part of the mechanism made in accordance with the invention and incorporated in the timepiece.

The timepiece 1 of FIGS. 1 and 2 comprises a chronograph whose hands 2 and 3 are driven by a first gear train 4, which in turn drives a resonator 5. In particular, and as shown in FIG. 1, the chronograph taken by way of example here is fitted with a direct drive seconds-hand 2 and a hand 3 fitted to a retrograde minute counter. Hands 2 and 3 are driven by the first gear train 4 shown in FIG. 2 where direct drive seconds-hand 2, not shown, is mounted on the fourth wheel 21 forming part of first gear train 4. The minute counter that drives retrograde hand 3 is not shown in the drawing, but it is connected in a known manner to the first gear train 4. This first gear train 4 in turn drives, at the end of its travel, a first resonator 5. This resonator has a sprung balance 22 on the arbour of which is secured a roller 23 fitted with an impulse pin actuated by pallets 24 that cooperate with an escape wheel 25, driven by the last wheel 50 of gear train 4.

The timepiece of FIGS. 1 and 2 also includes a watch whose hands 6 and 7 are driven by a second gear train 8, independent of first gear train 4, wherein said second gear train 8 in turn drives a second resonator 9. In particular, and as shown in FIG. 1, the watch taken as an example here is fitted with a minute hand 6 and an hour hand 7. The hands are driven by the second gear train 8 shown in FIG. 2. Said hands are fitted in a known manner, but not shown in FIG. 2, onto a centre pinion 26, which forms the first wheel set of second gear train 8. This second gear train 8 in turn drives, at the end of its travel, a second resonator 9. This resonator has a sprung balance 27 on the arbour of which there is secured a roller 28, fitted with an impulse pin, actuated by pallets 29 that cooperate with an escape wheel 30 driven by the last wheel 31 of gear train 8.

Figure 3:
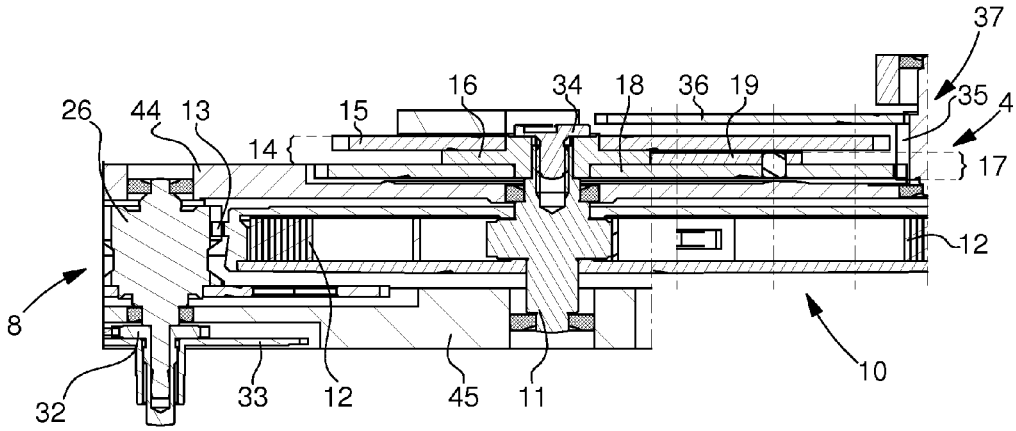
FIG. 3 is a cross-section in the energy source powering the timepiece according to the invention, wherein said energy source is meshed both with the gear train of the watch and with the chronograph train.

According to the main feature of the present invention, FIGS. 1, 2 and 3 clearly show that the first and second gear trains 4 and 8 are driven from a single energy source 10, which differentiates the present invention from the aforecited device of EP Patent No. 1333345, where the chronograph and watch gear trains are each driven by their own energy source.

In particular, in the timepiece taken by way of example here, the energy source is a barrel 10 that rotates freely about an arbour 11, and barrel 10 contains a mainspring 12 as shown clearly in FIG. 3. Arbour 11 pivots between a plate 44 and a bridge 45.

Barrel 10 carries, in a usual manner, a crown wheel 13 directly meshed with centre pinion 26, which is the starting point of the second gear train 8 driving the watch mechanism. One can also imagine starting the first gear train driving the chronograph mechanism from this crown wheel 13, in which case the main feature of the present invention, namely driving the first and second gear trains 4 and 8 from a single barrel, would also be satisfied. In this configuration, switching on the chronograph has no effect at all on the working of the watch, since the chronograph gear train is not derived from the watch train. This solution, not described in detail here, requires the use of a coupling mechanism for disconnecting the chronograph train from the barrel when the chronograph is stopped.

Figure 4:
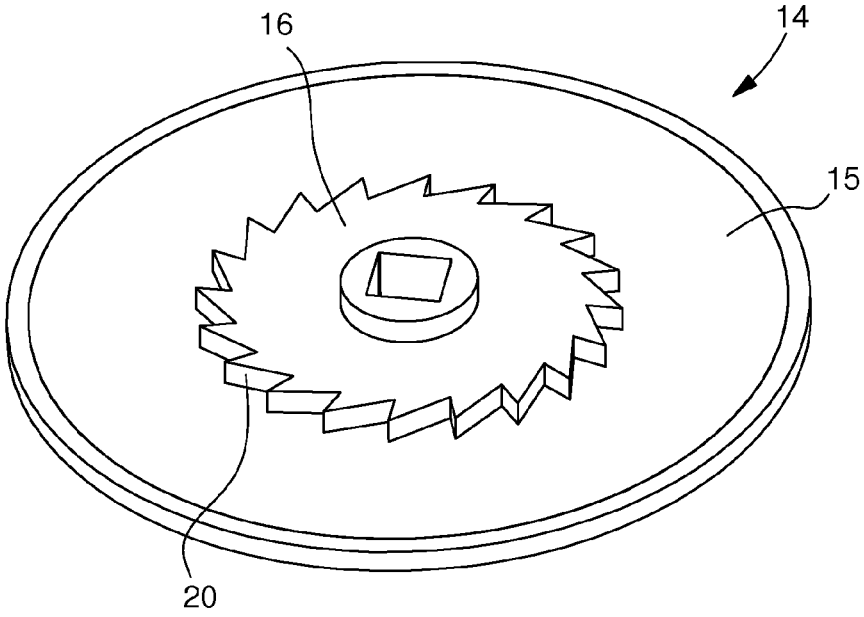
FIG. 4 is a perspective view of the winding ratchet, fitted to the energy source of the invention.
Figure 5:
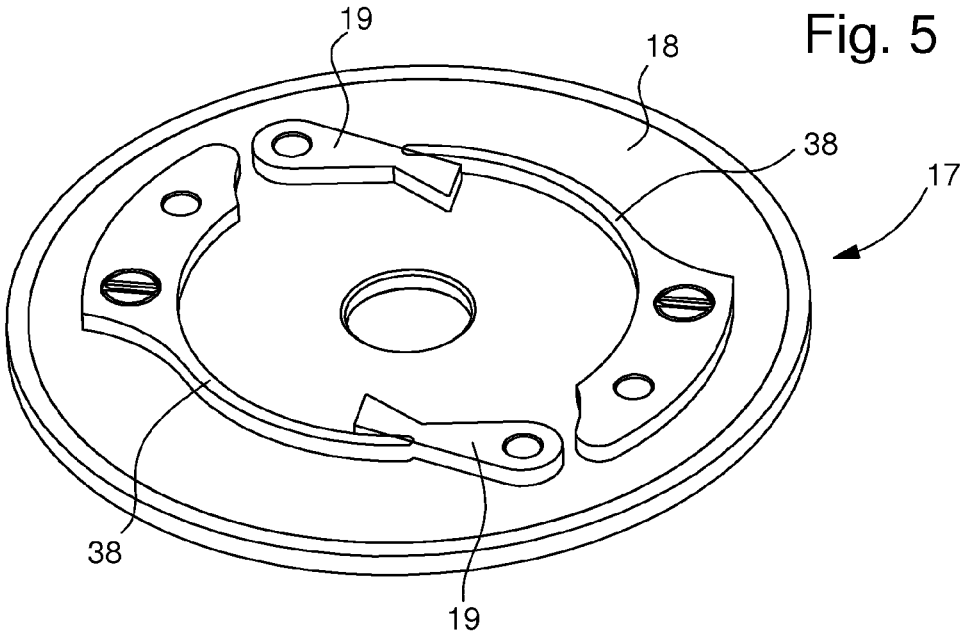
FIG. 5 is a perspective view of the chronograph drive ratchet, which is fitted to the energy source of the invention.

We will now described an original solution enabling the first and second gear trains 4 and 8 to be directly driven by barrel, which is of particularly simple design and which avoids the use of the coupling mechanism cited in the preceding paragraph. Reference will be made more particularly to FIGS. 3, 4 and 5.

As the cross-section of FIG. 3 shows, barrel 10 carries a crown wheel 13 meshed with the second gear train 8. The first wheel set of this second gear train is centre pinion 26 onto which a cannon-pinion, carrying minute hand 6, and an hour wheel 33, carrying hour hand 7, are fitted. Barrel 10 contains mainspring 12 and rotates freely about arbour 11. A first assembly 14 (see also FIG. 4), formed of a winding ratchet 15 and a wolf tooth wheel 16, is secured to arbour 11 and secured thereto by means of a screw 34. Winding ratchet 15 enables spring 12 to be wound and is thus connected to a winding mechanism, which is not shown in the drawing. The barrel also carries a second assembly 17 (see also FIG. 5) arranged between the first assembly 14 and barrel 10. This second assembly rotates freely about arbour 11 and has a drive ratchet 18 and at least one click 19 (here two clicks 19 are used) cooperating with the teeth 20 of wolf tooth wheel 16. Springs 38 press clicks 19 against wolf tooth wheel 16. Drive ratchet 18 is meshed with the first gear train 4, in this case with the first wheel set 37 of the first gear train that includes a pinion 35 and a wheel 36.

The device that has just been describes operates as follows:

Spring 12 of barrel 10 is wound by crown 43 fitted to the winding mechanism. The first assembly 14 including winding ratchet 15 and the wolf tooth wheel 16 rotates anticlockwise. During this operation, second assembly 17 including drive ratchet 18 and clicks 19 is held still by a brake (not shown in the drawing) preventing centre wheel 40, which belongs to fourth wheel set 21, from rotating. Clicks 19 jump over teeth 20 of wolf tooth wheel 16 and no torque is imparted to drive ratchet 18. During the winding operation and thereafter the spring is wound such that crown wheel 13 of barrel 10 rotates anticlockwise and drives centre pinion 26 of the watch clockwise and the hour and minute hands connected thereto are driven with it.

When the chronograph is started, the brake acting on centre wheel 40 of said chronograph is released. Under the effect of spring 12 of barrel 10, the wolf tooth wheel 16 starts to rotate clockwise, i.e. in the opposite direction to that which it had during winding. Consequently, clicks 19 are engaged by the toothing of wolf tooth wheel 16, which causes the drive ratchet 18 to rotate clockwise and to drive the first chronograph gear train 4. Fourth wheel set 21, connected to gear train 4, will also rotate clockwise via the intervention of wheel set 37 formed of pinion 35 and wheel 36.

Thus, from the description that has just been given, it is clear that gear trains 4 and 8 respectively relating to the chronograph and the watch are totally independent of each other and that the working or stopping of the chronograph has no influence on the working accuracy of the watch. At most, the operation of the chronograph decreases the power reserve of the timepiece.

We have omitted from the above description an explanation as to how the chronograph hands are started, stopped and reset, which is known to those skilled in the art. In particular a column wheel or a cam is commonly used for these functions, a description of which can be read in the work "Le Chronographe", cited in the preamble of this document. Likewise, the chronograph may have a single push button for starting, stopping and resetting its direct drive seconds hand, or two push buttons as shown in FIG. 1, where the right hand push button 41 starts and stops hands 2 and 3 and the left hand push button 42 resets the hands.

The timepiece that has just been described includes two resonators 5 and 9. Generally, the watch resonator 9 is sized such that its balance 27 executes 18,000 vibrations per hour, which results in a $5^{th}$ of a second display. The chronograph resonator 5 can be sized such that its balance 22 executes 36,000 vibrations per hour, which allows a $10^{th}$ of a second display for the chronograph seconds hand. Thus, advantage can be taken of the presence of two distinct resonators to oscillate the chronograph resonator at a higher frequency than the watch resonator frequency.

What is claimed is:

1. A timepiece including a chronograph, whose hands are driven by a first gear train, which in turn drives a first resonator, and a watch whose hands are driven by a second gear train independent of the first gear train, wherein said second gear train in turn drives a second resonator, wherein the first and second gear trains are driven from a single energy source.

2. The timepiece according to claim 1, wherein the energy source is a barrel rotating freely about an arbour, wherein said barrel contains a mainspring.

3. The timepiece according to claim 2, wherein the barrel carries a crown wheel meshed with the second gear train and wherein a first assembly formed of a winding ratchet and a wolf tooth wheel is secured to the arbour of the barrel, wherein a second assembly is arranged between the first assembly and the barrel, said second assembly rotates freely about said arbour and has a drive ratchet meshed with the first gear train and at least one click hinged on said drive ratchet, and said click cooperates with the teeth of the wolf tooth wheel.

4. The timepiece according to claim 1, wherein the first resonator has a higher frequency than the frequency of the second resonator.

* * * * *